US009910379B2

(12) United States Patent
Furukawa et al.

(10) Patent No.: US 9,910,379 B2
(45) Date of Patent: Mar. 6, 2018

(54) CHARGING MEMBER WITH CONCAVE PORTIONS CONTAINING INSULATING PARTICLES AND ELECTROPHOTOGRAPHIC APPARATUS

(71) Applicant: CANON KABUSHIKI KAISHA, Tokyo (JP)

(72) Inventors: Takumi Furukawa, Susono (JP); Hiroaki Watanabe, Odawara (JP); Kenya Terada, Suntou-gun (JP); Yuya Tomomizu, Yokohama (JP); Toshiro Suzuki, Gotemba (JP); Kenichi Yazawa, Suntou-gun (JP); Kazuhiro Gesho, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/332,240

(22) Filed: Oct. 24, 2016

(65) Prior Publication Data

US 2017/0115590 A1 Apr. 27, 2017

(30) Foreign Application Priority Data

Oct. 26, 2015 (JP) ..... 2015-210022
Aug. 9, 2016 (JP) ..... 2016-156600

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
USPC ..... 399/176
See application file for complete search history.

(56) References Cited

U.S. PATENT DOCUMENTS 4,420,548 A 12/1983 Sakai et al.
5,198,685 A 3/1993 Kitani et al.
7,529,504 B2 * 5/2009 Inagaki ..... G03G 5/0539 399/116

(Continued)

FOREIGN PATENT DOCUMENTS

JP H11-174784 7/1999
JP 2008-276024 11/2008

OTHER PUBLICATIONS

U.S. Appl. No. 15/332,437, Kenya Terada, filed Oct. 24, 2016.

*Primary Examiner* — Billy Lactaoen
(74) *Attorney, Agent, or Firm* — Fitzpatrick Cella Harper and Scinto

(57) ABSTRACT

Provided a charging member comprising an electro-conductive support and an electro-conductive surface layer, the surface layer including on the outer surface thereof, concave portions that are independent of each other, and holding an insulating particle in each of the concave portions, the insulating particle being exposed to the surface of the charging member and forms a convex portion on the surface of the charging member, in an orthogonal projection image of which the concave portions and the insulating particle are projected on a surface of the electro-conductive support, a site in which an outer edge of a projection image derived from the insulating particle and an outer edge of a projection image derived from each of the concave portions are separated, exists, and a part of a wall of each of the concave portions constitutes a part of the surface of the charging member.

5 Claims, 5 Drawing Sheets

(56) References Cited

U.S. PATENT DOCUMENTS

| | | | | |
|---|---|---|---|---|
| 7,693,457 | B2 | 4/2010 | Kuruma et al. | |
| 7,962,068 | B2 | 6/2011 | Kuroda et al. | |
| 8,440,307 | B2 | 5/2013 | Nose et al. | |
| 8,445,113 | B2 | 5/2013 | Furukawa et al. | |
| 8,469,867 | B2 | 6/2013 | Kuroda et al. | |
| 8,481,167 | B2 | 7/2013 | Watanabe et al. | |
| 8,491,994 | B2 | 7/2013 | Harada et al. | |
| 8,501,312 | B2 | 8/2013 | Watanabe et al. | |
| 8,501,325 | B2 | 8/2013 | Tomomizu et al. | |
| 8,503,911 | B2 | 8/2013 | Suzumura et al. | |
| 8,526,857 | B2 | 9/2013 | Tomomizu et al. | |
| 8,532,535 | B2 | 9/2013 | Nose et al. | |
| 8,538,298 | B2 | 9/2013 | Harada et al. | |
| 8,622,881 | B1 | 1/2014 | Harada et al. | |
| 8,685,601 | B2 | 4/2014 | Nose et al. | |
| 8,750,762 | B2 | 6/2014 | Harada et al. | |
| 8,755,714 | B2 | 6/2014 | Nagamine et al. | |
| 8,923,732 | B2 | 12/2014 | Harada et al. | |
| 8,991,053 | B2 | 3/2015 | Watanabe et al. | |
| 9,360,833 | B2 | 6/2016 | Terada et al. | |
| 9,372,428 | B2 | 6/2016 | Kuroda et al. | |
| 9,372,429 | B2 | 6/2016 | Watanabe et al. | |
| 2012/0076535 | A1 | 3/2012 | Nagamine et al. | |
| 2013/0004206 | A1 | 1/2013 | Kuroda et al. | |
| 2013/0034369 | A1 | 2/2013 | Masu et al. | |
| 2013/0064571 | A1 | 3/2013 | Kodama et al. | |
| 2013/0272747 | A1* | 10/2013 | Watanabe | B05D 5/00 399/168 |
| 2014/0169826 | A1* | 6/2014 | Higaki | G03G 15/0258 399/100 |

* cited by examiner

CHARGING MEMBER WITH CONCAVE PORTIONS CONTAINING INSULATING PARTICLES AND ELECTROPHOTOGRAPHIC APPARATUS

BACKGROUND OF THE INVENTION

Field of the Invention

The present invention relates to a charging member for use in an electrophotographic apparatus and to an electrophotographic apparatus.

Description of the Related Art

As a charging member for contact charging of a body to be charged such as an electrophotographic photosensitive member, Japanese Patent Application Laid-open No. 2008-276024 discloses a charging member including an outermost layer containing electro-conductive carbon particles dispersed in a binder resin. In addition, Japanese Patent Application Laid-Open No. 2008-276024 also discloses a charging member having convex portions derived from electro-conductive carbon particles on the surface thereof as a preferred embodiment.

Japanese Patent Application Laid-Open No. H11-174784 discloses, as a charging apparatus capable of preventing contamination from adhering to the surface of a charging roller, a charging apparatus in which a charging member is driven at a different peripheral speed from a photosensitive member.

SUMMARY OF THE INVENTION

One aspect of the present invention is directed to the provision of a charging member that can suppress charge injection into a photosensitive member and can stably charge a photosensitive member even when used in an electrophotographic image forming apparatus having high process speeds.

In addition, another aspect of the present invention is directed to the provision of an electrophotographic apparatus capable of providing a high-quality electrophotographic image.

According to one aspect of the present invention, there is provided a charging member including an electro-conductive support and an electro-conductive surface layer. The electro-conductive surface layer includes, on an outer surface thereof, concave portions that are independent of each other, and holds an insulating particle in each of the concave portions, the insulating particle being exposed to a surface of the charging member and forming a convex portion on the surface of the charging member, wherein, when each of the concave portions and the insulating particle held in each of the concave portions are orthogonally projected on a surface of the electro-conductive support and orthogonal projection image is obtained, in the orthogonal projection image, a site in which an outer edge of a projection image derived from the insulating particle and an outer edge of a projection image derived from each of the concave portions are separated, exists, a part of a wall of each of the concave portions constitutes a part of the surface of the charging member.

According to another aspect of the present invention, there is provided an electrophotographic apparatus including the charging member and a member to be charged placed in contact with the charging member and chargeable by the charging member.

Further features of the present invention will become apparent from the following description of exemplary embodiments with reference to the attached drawings.

DESCRIPTION OF THE EMBODIMENTS

Figure 1:
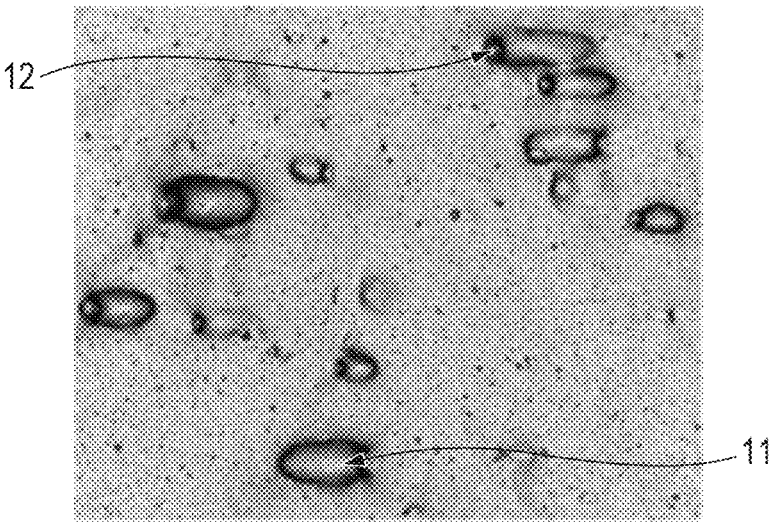
FIG. 1 is a view (photograph) showing an example of a surface conformation of a charging member.

Preferred embodiments of the present invention will now be described in detail in accordance with the accompanying drawings.

The inventors of the present invention have adopted a charging member having, on the surface thereof, convex portions derived from electro-conductive particles such as electro-conductive carbon particles in the charging apparatus disclosed in Japanese Patent Application Laid-Open No. H11-174784, and have found that a photosensitive member cannot be stably charged in some cases. This is supposed to be because the convex portions of the charging member, which mainly come into contact with the photosensitive member, are derived from electro-conductive particles and thus charges are injected from the charging member into the photosensitive member at the contact points when the photosensitive member and the charging member are driven at different peripheral speeds. In other words, as charges are injected, the surface potential of the photosensitive member fails to converge at a constant value, and the surface potential of the photosensitive member increases every rubbing of the rotating photosensitive member against the charging roller. This is supposed to be the reason for unstable potential of the photosensitive member.

Meanwhile, the study by the inventors of the present invention has indicated a charging member having convex portions derived from insulating particles such as resin particles on the surface thereof is unlikely to cause such a problem of destabilization of the potential of a photosensitive member due to charge injection as described above. However, the inventors of the present invention understand that the charging member having convex portions derived from insulating particles on the surface thereof is difficult to accommodate to higher process speeds of recent electrophotographic image forming apparatuses. The term "insulating" as used in the specification, means "electrically insulating".

In other words, when once discharge occurs from convex portions derived from insulating particles, discharge cannot occur from the same convex portions until the convex portions store charges. The inventors of the present invention thus have conducted studies in order to provide a charging member that can suppress charge injection into a body to be charged and can accommodate higher process speeds, and consequently have completed the present invention.

A charging member according to one aspect of the present invention includes an electro-conductive support and an electro-conductive surface layer.

The surface layer can be formed from an electro-conductive elastic material. The surface of the surface layer has concave portions that are independent of each other, and the surface layer holds an insulating particle in each of the concave portions. The "concave portion" as used herein means not only a portion recessed in a charging member as the end product, but means a recess in the surface layer (typically the surface of the electro-conductive elastic material) including a portion occupied by the elastic particle as well.

The insulating particle in the respective concave portions is exposed to the surface of the charging member and form convex portions. In other words, the insulating particles are not buried in the constituent materials (except the insulating particles) of the surface layer, and parts of the particles protrude from the surface layer constituent materials (except the insulating particles).

When each of the concave portions and the insulating particle held in respective concave portions are orthogonally projected on to a surface of the support, and an orthogonal projection image is obtained, in the orthogonal projection image, a site in which the outer edge of a projection images derived from each of the concave portions and the outer edge of a projection image derived from the respective insulating particles are separated, exists, and a gap is formed. A part of the wall of each of the concave portions constitutes a part of the surface of the charging member. In other words, at least a part of the wall of each of the conceive portions is exposed at the surface instead of being covered with the insulating particles.

The inventors of the present invention suppose the reason the convex portions of the charging member according to one aspect of the present invention are derived from insulating particles but the charging member can accommodate to higher process speeds as follows.

Figure 2A:
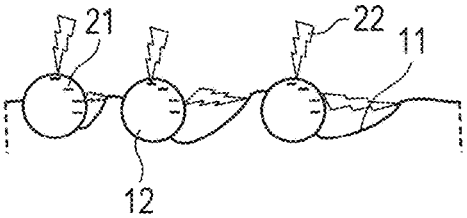
FIG. 2A is a schematic view showing an example oil a surface shape of the charging member.
Figure 2B:
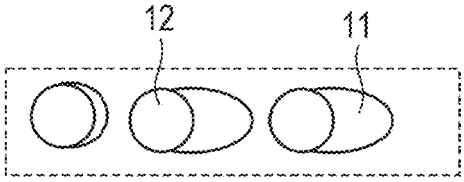
FIG. 2B is a schematic view showing an example of the surface shape of the charging member.
Figure 2C:
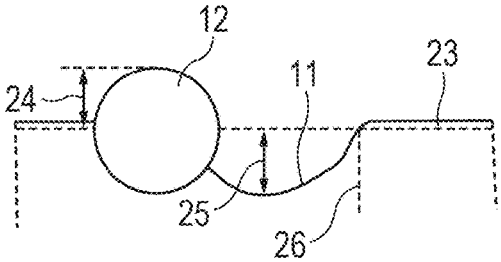
FIG. 2C is a schematic view showing an example of the surface shape of the charging member.

First, FIG. 1 shows an example of the surface of the charging member of the present invention. FIG. 2A is a projection view (cross-sectional view) viewed in a tangential direction to the surface of the charging member, and FIG. 2B is a projection view in a normal direction to the surface of the charging member.

The surface of the charging member means a face that comes in contact with or comes close to a body to be charged. A typical charging member has a certain surface roughness, and the standard face for defining a normal direction or a tangential direction to the surface of the charging member is a face that passes through the average line of surface roughness in the height direction. An electro-conductive rubber composition as the material for forming the surface layer constitutes concave portions 11. The outer surface of the surface layer thus has a plurality of concave portions that are independent of each other. In each of the concave portions 11, the insulating particle is present. In the projection view from a point of view in the normal direction with respect to the surface of the charging member, at least part of the outer edge of the insulating particle and the outer edge of the concave portion in which the insulating particle is present are present in a separate state. In other words, in this projection view, there is a site in which the outer edge of a projection image derived from the insulating particle and the outer edge of a projection image derived from the concave portion are separated. The site includes a gap surrounded by the wall of the insulating particle and the wall of the concave portion. The insulating particles form convex portions 12.

FIG. 2A is a schematic projection view in a tangential direction to the surface of the charging member. Discharge occurs between an insulating particle and a part that is included in the outer edge of an electro-conductive concave portion and is not in contact with the outer edge of the insulating particle, and the discharge causes charge-up 21 of the convex portion of the insulating particle. This increases the potential difference between a photosensitive member and the convex portion and causes strong discharge 22. It is thus supposed that even the convex portions of insulating particles can provide charging uniformity substantially equal to electro-conductive convex portions having the same height. This action requires a potential difference between a convex portion and a concave portion derived from an insulating particle and a gap. The case in which insulating particles are replaced with electro-conductive particles or the whole outer edge of the insulating particle is in contact with the concave portions does not express this action.

The charge-up of the convex portions composed of the insulating particles occurs before passage through a nip between a photosensitive member and the charging member, and discharge occurs when the distance between the photosensitive member and the charging member becomes such a value as to be capable of discharging. At the time of passage through the nip, the charge of convex portions on which charge-up had occurred and charge had been stored has decreased, and thus almost no charge transfer occurs on contact with the photosensitive member. This is likely to suppress the phenomenon in which the potential of a photosensitive member continues to increase, which may occur in the case of electro-conductive particles.

The surface shape of the charging member for providing such an action will be described with reference to the cross-sectional view 2C. A normal direction to the charging member surface is expressed as height. The insulating particles preferably have an average particle size of 6 μm or more to 30 μm or less. When the average particle size is 6 μm or more, horizontal streak-like image failures caused by intermittent discharge at a downstream side arising from insufficient discharge at an upstream side in the rotation direction of a photosensitive member can be easily suppressed. When the average particle size is 30 μm or less, image failures with dots (called fogging) due to a decrease of charged potential by adhesion of toner, additives, or paper dust to the periphery of convex portions can be easily prevented from occurring.

The height 24 of a convex portion 12 of the insulating particle is higher than the height of an average line 23 of the surface shape and is preferably higher by 3 μm or more. When the convex portions are higher, horizontal streak-like image failures caused by intermittent discharge at a downstream side arising from insufficient discharge at an upstream side in the rotation direction of a photosensitive member can be easily suppressed.

The depth 25 of a gap surrounded by the wall of the insulating particle and the wall of the concave portion is lower than the height of an average line 23 of the surface shape, and the depth of the gap is preferably equal to or more than ⅓ of the average particle size.

The outer edge 26 of the projection image derived from the concave portion is defined as the periphery of the concave portion along which the outline of the concave portion intersects with the height of an average line. The outer edge of the projection image derived from the insulating particle means the outer edge formed by the outline of the insulating particle in the orthogonal projection image. In the present specification, the terms "outer edge of a concave portion" and "outer edge of an insulating particle" mean "outer edge of the projection image derived from a concave portion" and "outer edge of the projection image derived from an insulating particle", respectively, unless otherwise noted.

Figure 2D:
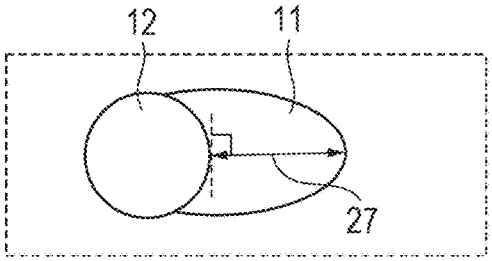
FIG. 2D is a schematic view showing an example of the surface shape of the charging member.

The distance of the site in which the outer edge of the projection image derived from an insulating particle and the outer edge of the projection image derived from the concave portion are separated in the projection view from the point of view in the normal direction with respect to the surface of the charging member (hereinafter sometimes referred to as "gap portion distance") will be described. A gap portion distance 27 is defined as the longest line segment out of the line segments formed by lines each drawn from one certain point of the outer edge of the insulating particle in a normal direction and points of intersection between the lines and the outer edge of the concave portion in a projection view on the surface from the point of view in the normal direction with respect to the surface of the charging member (FIG. 2D). The gap portion distance 27 is preferably 10 μm or more to 70 μm or less. When the gap portion distance 27 is 10 μm or more to 70 μm or less, discharge occurs between the convex portion and a corner of the concave portion present at the outer edge of the concave portion, and charge-up of the insulating convex portion occurs to increase the local electric field at a gap to a photosensitive member. Accordingly, strong-discharge occurs, and charging uniformity is easily achieved.

The depth of the gap from the height of an average line of the surface shape is preferably 10% or more to 50% or less when the gap portion distance 27 is 100%. When the proportion is 10% or more, charging uniformity is easily achieved. When the proportion is 50% or less, satisfactory discharge occur at the bottom of the gap, and this easily prevents image failures with dots (called fogging) arising from insufficient local discharge between the bottom of the gap and a photosensitive member from occurring.

The concave portions may have any shape including a hemispherical shape, a semi-oval shape, and an indefinite shape. The shape of the concave portions is exemplified in FIG. 6A to FIG. 6F. FIG. 6A to FIG. 6F are projection view s each viewed in a normal direction to the surface of the charging member. In FIG. 6A to FIG. 6F, insulating particles 112 are indicated by black circles. It is more preferred that at least part of the portion in which the outer edge of an insulating particle 112 and the outer edge 26 of the concave portion are separated to be located between an alternate long and short dash line that is spaced 10 μm apart from the insulating particle and an alternate long and two short dashes line that is spaced 70 μm apart from the insulating particle.

Figure 7:
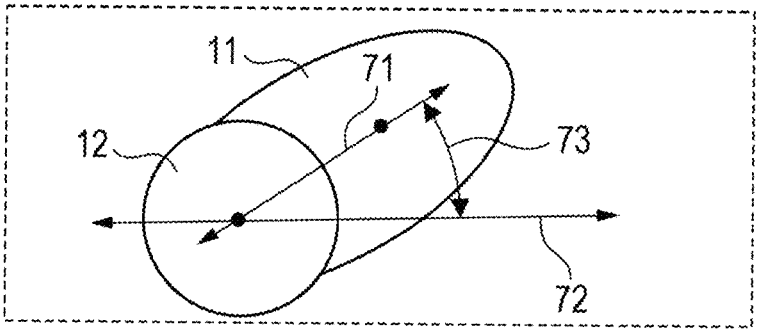
FIG. 7 is a schematic view for describing the orientation of the position of the center of gravity of a gap relative to the position of the center of gravity of an insulating particle.

In a projection view in a normal direction to the surface of the charging member, the position of the center of gravity of the gap surrounded by the outer edge of an insulating particle and the outer edge of the concave portion is preferably oriented in the longitudinal direction of the charging member (axis direction in the case of a charging roller) relative to the position of the center of gravity of the insulating particle. This is because such a charging member is more effectively prevented from causing horizontal streak-like image failures along the longitudinal direction. The degree of orientation may be represent by the average of an acute angle 73 formed, in a projection view (FIG. 7) from a point of view in a normal direction with respect to the surface of the charging member, between a direction 71 connecting the center of gravity of the insulating particle and the center of gravity of the gap, and the longitudinal direction 72 of the charging member. The value is between 0° and 90°, 90° means orientation in a direction orthogonal to the longitudinal direction (rotation direction in the case of a charging roller), 45° means non-orientation, and 0° means orientation in the longitudinal direction. When the angle is less than 45°, insulating particle and the gap is oriented in the longitudinal direction of the charging member. The angle is preferably 0° or more to 20° or less.

The number of the concave portions (concave portions with insulating particles) is not limited to particular values and is, for example, about 0.2 or more to 10 or less in a 100-μm square on the surface of the surface layer. Concave portions without insulating particles and insulating particles that are not present in concave portions may be present.

Preferred embodiments of the present invention will next be described in detail.

<Charging Member>

Figure 3:
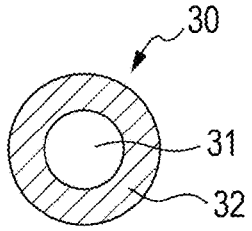
FIG. 3 is a schematic view showing a configuration example of a charging roller.

FIG. 3 shows a configuration view of a charging roller as an example of the charging member of the present invention.

The charging roller 30 includes a mandrel 31 as an electro-conductive support and a surface layer 32 formed on the mandrel 31.

The components constituting the charging member will be sequentially described.

(Insulating Particles)

On the surface layer, insulating particles are exposed. The insulating particles may be any insulating particles having a volume resistivity of $10^{10}$ Ωcm or more. The volume resistivity of insulating particles can be determined by the following procedure. Insulating particles are compressed to be pelletized, and the volume resistivity of the resulting pellet is measured with a powder resistivity meter (trade name: Powder resistivity measurement system MCP-PD51, manufactured by Mitsubishi Chemical Analytech Co., Ltd.).

For pelletization, insulating particles to be measured are placed in a cylindrical chamber having a diameter of 20 mm in the powder resistivity meter. The loading amount is set so that the particles are compressed at 20 kN to give a pellet having a thickness of 3 to 5 mm. The measurement is performed in an environment at 23° C./50% RH (relative humidity) at an applied voltage of 90 V and a load of 4 kN.

The insulating particles may be formed from any material, but are exemplified by resin particles formed from at least one resin selected, for example, from a phenol resin, a silicone resin, a polyacrylonitrile, a polystyrene, a polyurethane, a nylon resin, a polyethylene, a polypropylene, and an acrylic resin, and inorganic particles formed from at least one inorganic substance selected, from silica, alumina, and zirconia.

The surface roughness is preferably a ten-point average roughness Rz of 6 μm or more to 30 μm or less where the above requirements for the insulating particles and the shape of the concave portions (an average particle size of 6 to 30 μm, a gap portion distance of 10 to 70 μm) are satisfied. The Rz is in accordance with JIS B0601: 1982.

When the ten-point average roughness is 6 μm or more, horizontal streak-like image failures caused by intermittent discharge at a downstream side arising from insufficient discharge at an upstream side in the rotation direction due to a small surface roughness can be easily suppressed. When the ten-point average roughness is 30 μm or less, fogging arising from insufficient local discharge between valley portions of the surface shape and a photosensitive member can be easily suppressed.

The average particle size of insulating particles is "length-average particle diameter" determined by the following procedure. First, insulating particles are observed under a scanning electron microscope (manufactured by JEOL Ltd., trade name: JEOL LV5910), and an image is recorded. The recorded image is analyzed by using an image analysis software (trade name: Image-Pro Plus, manufactured by Planetron). In the analysis, the pixel number per unit length is calibrated on the basis of a micron bar at the time of photograph recording. Unidirectional diameters of 100 particles randomly selected from the photograph are measured on the basis of the pixel number on the image, and an arithmetic average particle size is calculated to give the average particle size of the insulating particles.

As for the sphericity of insulating particles, the average value of shape factors SF1 described below is preferably 100 or more to 160 or less. Here, the shape factor SF1 is an index calculated in accordance with Equation (1), and a particle having a shape factor closer to 100 is more spherical. Even when insulating particles having an average shape factor of 160 or less are exposed on the surface layer and come into direct contact with a photosensitive member, the photosensitive member can be prevented from being abraded or scratched.

The shape factor SP1 of an insulating particle can be determined by the following procedure. Image information recorded under a scanning electron microscope in the same manner as the particle size measurement is input into an image analysis device (manufactured by Nireco Corporation, trade name: Lusex3), and SF1 of each of 100 particle images randomly selected is calculated in accordance with Equation (1). The average value can be an arithmetic average of the calculated values.

$$SF1=\{(MXLING)^2/AREA\}\times(\pi/4)\times(100) \quad (1)$$

where MXLNG is an absolute maximum length of a particle, and AREA is the projected area of the particle)

The insulating particles exposed on the surface of the surface layer may be a combination of two or more types of insulating particles or insulating particles formed of a copolymer of resins.

(Concave Portion)

As the existential state of the electro-conductive concave portions, concave portions formed by recessing of part of an electro-conductive elastomer composition formed on the surface of the surface layer are exemplified. The electro-conductive elastomer composition preferably has a volume resistivity of $10^3$ Ωcm or more to $10^9$ Ωcm or less and is an elastomer composition prepared by appropriately adding an electro-conductive material, a crosslinking agent, and the like to a material elastomer.

The volume resistivity of an electro-conductive elastomer composition can be determined by a 4-terminal 4-probe method by using a resistivity meter (trade name: Loresta GP, manufactured by Mitsubishi Chemical Analytech Co., Ltd.). In order to prepare a sample, a rubber composition is placed in a mold having a thickness of 2 mm and is crosslinked at 10 MPa and 160° C. for 10 minutes. giving a rubber sheet having a thickness of 2 mm. The volume resistivity of the rubber sheet is measured by the 4-terminal 4-probe method. The measurement is performed in an environment of 23° C./50% RH (relative humidity) by using an ESP probe as the probe in conditions of a correction factor of 4.532, an applied voltage of 90 V, and a load of 10 N.

As the electro-conductive elastomer composition, an electro-conductive elastomer composition that is formed from rubber, a thermoplastic elastomer, or the like and is conventionally used in an electro-conductive elastic layer of a charging member, including an electro-conductive elastic layer of a charging roller for electrophotographic apparatuses can be used.

As the rubber, a rubber or a rubber composition containing polyurethane rubber, silicone rubber, butadiene rubber, isoprene rubber, chloroprene rubber, styrene-butadiene rubber, ethylene-propylene rubber, polynorbornene rubber, styrene-butadiene-styrene rubber, epichlorohydrin rubber, or the like is preferably used.

The thermoplastic elastomer is not limited to particular types, and a thermoplastic elastomer or a thermoplastic elastomer composition containing one or more thermoplastic elastomers selected from a general purpose styrene-based elastomer, an olefin-based elastomer, an amide-based elastomer, a urethane-based elastomer, an ester-based elastomer, and the like can be preferably used.

The conduction mechanism of electro-conductive elastomer compositions is roughly classified into two of an ionic conduction mechanism and an electron conduction mechanism.

Electro-conductive elastomer compositions having the ion conduction mechanism are typically composed of a polar elastomer typified by epichlorohydrin rubber, chloroprene rubber, and acrylonitrile-butadiene rubber (NBR) and an ion conductive material. The ion conductive material is such an ion conductive material as to be ionized in the polar elastomer to give ions having high mobility. The electric resistance of electro-conductive elastomer compositions having the ion conduction mechanism however greatly depend on environments and may be likely to cause bleeding or blooming due to such a mechanism that ions move to exhibit conductivity.

Electro-conductive elastomer compositions having the electron conduction mechanism are typically prepared by compounding and dispersing electro-conductive particles, such as carbon black, carbon fibers, graphite, metal fine powder, and a metal oxide, in an elastomer. The electro-conductive elastomer compositions having the electron conduction mechanism have the following advantages: the electric resistance depends on temperature and humidity in a smaller degree as compared with electro-conductive elastomer compositions having the ion conduction mechanism; bleeding or blooming is unlikely to be caused; and the compositions are inexpensive, for example.

In the charging member, an electro-conductive rubber composition having the electron conduction mechanism is preferably used because such a composition causes a phenomenon of charging a photosensitive member by charge transfer at contact points less frequently when the photosensitive member differs from the charging member in potential and peripheral speed.

The electro-conductive particles are exemplified by particles of electro-conductive carbon such as Ketjen Black EC and acetylene black; particles of carbon for rubber such as SAF, ISAF, HAF, FEF, GPF, SRF, FT, and MT; particles of metals and metal oxides such as tin oxide, titanium oxide, zinc oxide, copper, and silver; carbon particles for color (inks) subjected to oxidation treatment; pyrolytic carbon particles; natural graphite particles; and artificial graphite particles. The electro-conductive particles preferably do not give large convex portions, and electro-conductive particles having an average particle size of 10 nm to 300 nm are preferably used.

The loading amount of such electro-conductive particles can be appropriately set so that the electro-conductive elastic layer (surface layer) has an intended electric resistance in accordance with the types of a material elastomer, electro-conductive particles, and other compounding agents. For example, the loading amount can be 0.5 part by mass or more to 100 parts by mass or less and preferably 2 parts by mass or more to 60 parts by mass or less relative to 100 parts by mass of a polymer (material elastomer).

The electro-conductive elastomer composition can contain, an additional electro-conductive material, a filler, a processing aid, an antioxidant, a crosslinking aid, a crosslinking accelerator, a crosslinking accelerator aid, a crosslinking retarder, a dispersant, and other additives.

(Surface Layer)

The surface layer means a surface layer composed of an elastic material. The surface layer can be a multilayer. When the surface layer is a multilayer, a layer containing insulating particles is required to be formed as the outermost face. Between the electro-conductive support and the elastic layer, an adhesive layer may be formed.

In the present embodiment, the surface layer is preferably a single layer. This is because the production process is simplified. In this case, the surface layer preferably has a thickness of 0.8 mm or more to 4.0 mm or less and particularly preferably 1.2 mm or more to 3.0 mm or less in order to ensure a nip width between the surface layer and a photosensitive member.

As the method of forming a particular surface that is included in the charging member of the embodiment, a method of directly using the surface of an elastic layer produced by crosshead extrusion is preferred in order to simplify the production process.

In order to prevent the surface layer from having non-adhesiveness and to suppress bleeding, blooming, or the like from the inside of the surface layer, surface treatment by application of ultraviolet light or an electron beam may be performed.

(Electro-Conductive Support)

The electro-conductive support may be any support that has conductivity, can support the surface layer and the like, and can maintain the strength as the charging member, typically as a charging roller.

<Production Method of Charging Member>

As an example of a production method of the charging member regarding to this embodiment, an effective method from the viewpoint of simple production steps will be described. In other words, a production method of forming, by extrusion molding, a surface which has concave portions in which insulating particles are present, which has convex portions formed by the insulating particles, and in which at least part of the outer edges of the convex portions and the convex port ions are separated to form a gap is described.

The production method includes the following two steps and is a charging roller production method of forming, on the surface, gaps in which the interface between insulating particles and an electro-conductive rubber composition is detached.

A step of preparing an unvulcanized rubber composition that includes an electro-conductive rubber composition and insulating particles having an average particle size of 6 μm or more to 30 μm or less and has an elongation at break that is controlled at an appropriate value.

A step of subjecting the unvulcanized rubber composition to crosshead extrusion molding integrally with a mandrel while the unvulcanized rubber composition is drawn in such a way as to give a take-up ratio (described later) of 100% or less in the extrusion molding.

First, an unvulcanized rubber composition that contains an electro-conductive rubber composition and insulating particles and is to constitute the surface layer is prepared.

In the unvulcanized rubber composition, the content of the insulating particles is preferably 5 parts by mass or more to 50 parts by mass or less relative to 100 parts by mass of a material rubber. When the content is 5 parts by mass or more, a sufficient amount of the insulating particles can be present on the surface, and this can particularly reduce the contact area to a photosensitive member. When the content is 50 parts by mass or less, the amount of the insulating particles is not excessively large, and this can easily prevent the surface layer from hardening.

The inventors of the present invention have found that the gap portion distance can be controlled by an elongation at break that is determined by tension test of an unvulcanized rubber.

The elongation at break is determined by using a tension tester (trade name: RTG-1225, manufactured by A&D) in accordance with JJS K6254-1993. For the measurement, the tension speed is 500 mm/min, the breaking point measurement sensitivity is 0.01 N, the gauge length is 20 mm, the sample width is 10 mm, the sample thickness is 2 mm, the test temperature is 25° C., and the number of measurement times is twice.

The inventors consider that the elongation at break gives an indication that the stress is relaxed by the generation of fine cracks (voids) having a diameter of 3 μm or less. Hence, gaps formed by detachment of the interface between insulating particles and an electro-conductive rubber composition when stress is concentrated at the interface are unlikely to be formed when fine cracks help stress to relax. In other words, gaps are considered to be unlikely to be formed in an unvulcanized rubber having a small elongation at break. In order to control the stress relaxation by fine cracks, a filler having a small reinforcing performance is preferably mixed. Calcium carbonate is particularly preferred because it can control the elongation at break in a wide range by changing the amount to be added. In order to form gaps having appropriate sizes, the elongation at break is preferably 50% or more to 80% or less.

The formation of gaps by detachment can be controlled also by changing the Mooney viscosity of an unvulcanized rubber composition and the polarity difference or the adhesiveness between insulating particles and an electro-conductive rubber composition. A material rubber having a higher Mooney viscosity can give larger gaps.

In order to use the unvulcanized rubber composition and to detach the interface between insulating particles and the electro-conductive rubber composition to form gaps, a crosshead extrusion molding machine is used, and the unvulcanized rubber composition is drawn and molded. The crosshead extrusion molding machine is such an extruder that an unvulcanized rubber composition and a mandrel having a certain length are fed to the extruder at the same time and an unvulcanized rubber roller including the mandrel with the outer periphery uniformly covered with the rubber material having a certain thickness is extruded from an outlet port of the crosshead.

Figure 4A:
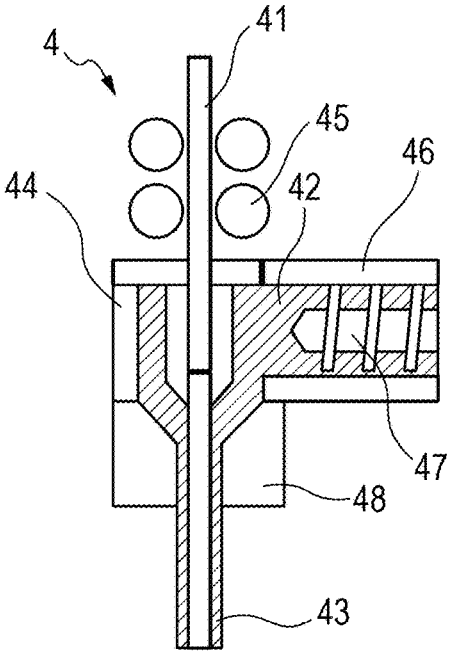
FIG. 4A is a schematic configuration view of an example of a crosshead extrusion molding machine.

FIG. 4A is a schematic configuration view of a crosshead extrusion molding machine 4. The crosshead extrusion molding machine 4 is a machine for uniformly covering the entire circumference of a mandrel 41 with an unvulcanized rubber composition 42 to produce an unvulcanized rubber roller 43 including the mandrel 41 at the center.

The crosshead extrusion molding machine 4 is equipped with a cross-head 44 to which a mandrel 41 and an unvulcanized rubber composition 42 are fed, conveyor rollers 45 for feeding the mandrel 41 to the crosshead 44, and a cylinder 46 for feeding the unvulcanized rubber composition 42 to the crosshead 44.

The conveyor rollers 45 continuously feed a plurality of mandrels 41 in the axis direction to the crosshead 44. The cylinder 46 is equipped with a screw 47 in the inside, and the screw 47 is rotated to feed the unvulcanized rubber composition 42 into the crosshead 44.

When the mandrel 41 is fed into the crosshead 44, the entire circumference is covered with the unvulcanized rubber composition 42 that is fed from the cylinder 46 into the crosshead. The mandrel 41 is then sent out from a die 48 at the outlet port of the crosshead 44 as an unvulcanized rubber roller 43 having the surface covered with the unvulcanized rubber composition 42.

Figure 4B:
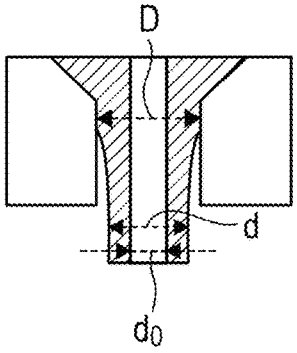
FIG. 4B is a schematic view of an example of the vicinity of a crosshead extrusion port.

By molding the unvulcanized rubber composition in such a manner as to give a smaller thickness as compared with a clearance of the extrusion port of the crosshead, or by drawing and molding the unvulcanized rubber, the interface between insulating particles and an electro-conductive rubber composition is detached to form gaps. FIG. 4B shows a schematic view of the vicinity of the crosshead extrusion port. When the inner diameter of the die of the crosshead extrusion port is D, the outer diameter of the unvulcanized rubber roller is d, and the outer diameter of the mandrel is $d_0$, $(d-d_0)/(D-d_0)$ corresponding to "(thickness of unvulcanized rubber composition)/(clearance of extrusion port)" is defined as take-up ratio (%). When the take-up ratio is 100%, the clearance of the extrusion port is equal to the thickness of the unvulcanized rubber composition. A smaller take-up ratio indicates molding while a composition is drawn in a larger degree, resulting in larger gaps. The take-up ratio is preferably 90% or less to 80% or more because gaps having appropriate sizes are formed. In typical molding, an unvulcanized rubber composition discharged from the extrusion port is shrunk due to die swell, giving a take-up ratio of 100% or more.

The take-up ratio is controlled by changing the relative ratio of the mandrel feed speed of the mandrel 41 by the conveyor rollers 45 and the feed speed of the unvulcanized rubber composition from the cylinder 46. At this time, the feed speed of the unvulcanized rubber composition 42 from the cylinder 46 to the crosshead 44 is set at a constant value. The ratio of the feed speed of the mandrel 41 and the feed speed of the unvulcanized rubber composition 42 determines the wall thickness of the unvulcanized rubber composition 42.

The unvulcanized rubber composition is molded into what is called a crown shape that has an outer diameter (wall thickness) larger at the center part of each mandrel 41 in the longitudinal direction than that at the end pares. Consequently, the unvulcanized rubber roller 43 is produced.

When crosslinking is required, the unvulcanized rubber roller is next heated to give a vulcanized rubber roller. Specific examples of the heat treatment method include blast furnace heating with a gear oven, heating vulcanization by far-infrared irradiation, and water vapor heating with a vulcanizer. Specifically, blast furnace heating and far-infrared heating are suited for continuous production and thus are preferred. When no crosslinking is required, for example, because a thermoplastic elastomer is used to form the surface layer, an unvulcanized rubber roller including the thermoplastic elastomer is appropriately cooled, for example, and can be directly used in place of a vulcanized rubber roller.

A vulcanized rubber composition at each end part of the vulcanized rubber roller is removed in the subsequent other step, and the vulcanized rubber roller is completed. Accordingly, each end part of the mandrel of the completed vulcanized rubber roller is exposed.

In the case of an electrophotographic apparatus gripping the exposed portion at each end part of a mandrel, a larger load is applied, to each end part of the charging roller. In the case of an electron conduct ion-type electro-conductive rubber composition, the load causes deterioration to increase the resistivity at each end part, and a horizontal streak-like image failure may be likely to be caused. When the charging roller is made into a crown shape by the production method, the take-up ratio is smaller at each end part than at the center part of the roller, and larger gaps are formed in the end parts. Hence, the effect of suppressing a horizontal streak-like image failure at each end part is particularly high. As for the proportion of the gap portion distance between the end parts and the center part, the gap portion distance of the end parts is more preferably 1.1 or more to 1.3 or less where the gap portion distance of the center part is 1.

The surface layer may be subjected to surface treatment by irradiation of ultraviolet light or an electron beam.

Other production methods include the following method, for example.

First, an unvulcanized rubber composition containing a foaming agent is prepared. The unvulcanized rubber composition is subjected to extrusion molding to give a vulcanized rubber roller. The surface of the vulcanized rubber roller is ground to exposed concave portions derived from voids formed by foaming. The concave portions are coated with thermoplastic insulating particles having a smaller diameter than the long diameter of the concave portions. The rubber roller is then heated at a temperature higher than the melting point of the thermoplastic insulating particle, and the insulating particle is closely bonded.

As compared with this method, the position of the center of gravity of insulating particle and the gap is oriented in the axis direction of the charging roller, in the charging roller obtained by the production method in which a composition is extruded while the elongation at break or the take-up ratio is controlled. Accordingly, such a roller has a higher effect of suppressing a horizontal streak-like image unevenness and is preferred.

Figure 5:
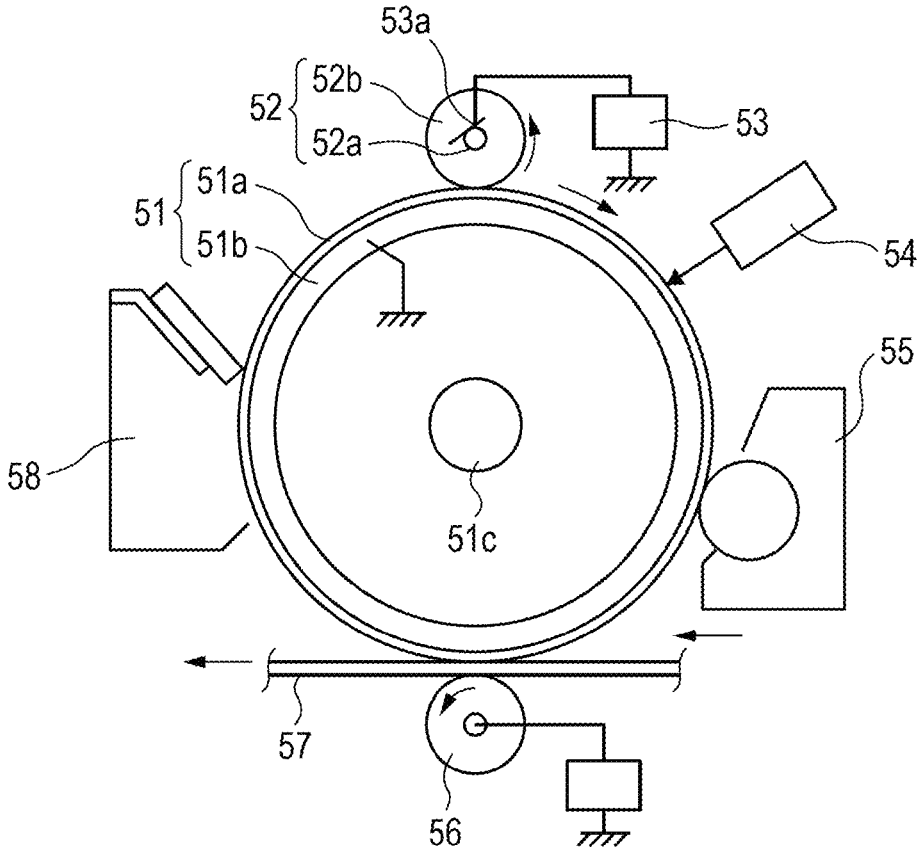
FIG. 5 is a schematic configuration view of an example of art electrophotographic apparatus including a charging member.
Figure 6A:
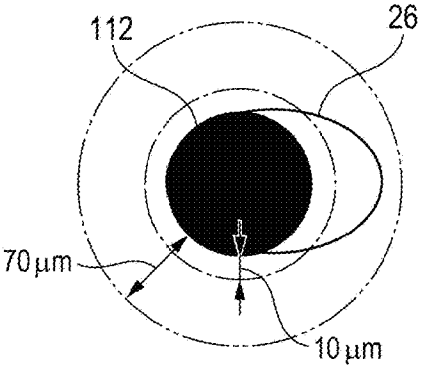
FIG. 6A is a schematic view showing an example of the shape of a concave portion.
Figure 6B:
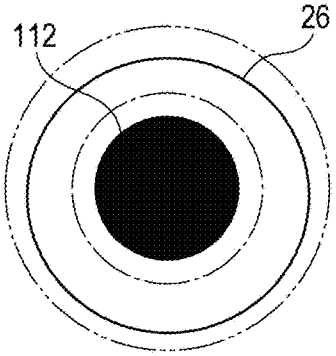
FIG. 6B is a schematic view showing an example of the shape of a concave portion.
Figure 6C:
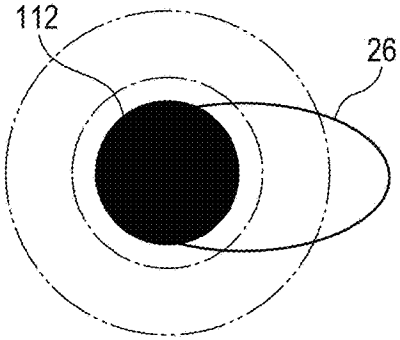
FIG. 6C is a schematic view showing an example of the shape of a concave portion.
Figure 6D:
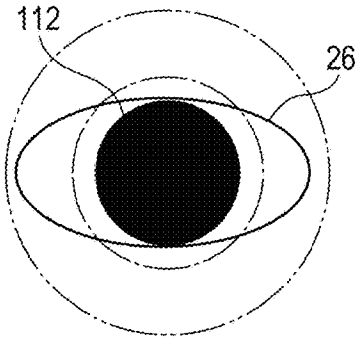
FIG. 6D is a schematic view showing an example of the shape of a concave portion.
Figure 6E:
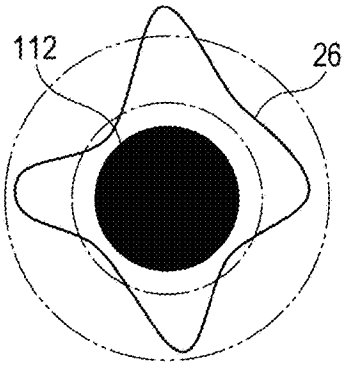
FIG. 6E is a schematic view showing an example of the shape of a concave portion.
Figure 6F:
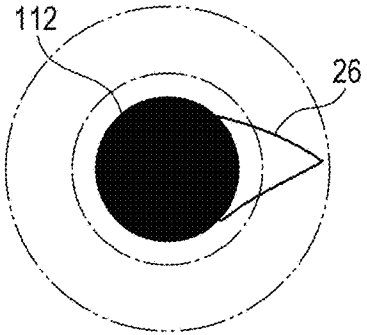
FIG. 6F is a schematic view showing an example of the shape of a concave portion.

Subsequently, an electrophotographic image forming process will be described with reference to the configuration view (FIG. 5) of an example of an electrophotographic apparatus including the charging member pertaining to the present embodiment. An electrophotographic photosensitive member (photosensitive member) 51 as the member to be charged includes an electro-conductive support 51*b* and a photosensitive layer 51*a* formed on the support 51*b* and has a cylindrical shape. The electrophotographic photosensitive member is driven clockwise as viewed in the figure around an axis 51*c* at the center at a predetermined peripheral speed. The member to be charged (photosensitive member 51) can be charged by a charging member (charging roller 52). From the viewpoint of removal of contamination on the charging member, the charging member is preferably capable of being driven at a charging member peripheral speed of 1.05 or more times or 0.95 or less times with respect to the peripheral speed of the member to be charged.

The charging roller 52 is placed in contact with the photosensitive member 51 and charges the photosensitive member 51 to a predetermined potential. The charging roller 52 includes a mandrel 52*a* and a surface layer 52*b* formed on the mandrel 52*a*. Each end part of the mandrel 52*a* is pressed by a pressing unit not shown in drawings against the electrophotographic photosensitive member 51, and the charging roller rotates following the photosensitive member 51 or rotates at a certain speed that differs from that of the photosensitive member 51. When a predetermined direct-current voltage is applied to the mandrel 52*a* from a power source 53 through a rubbing-friction electrode 53*a*, the photosensitive member 51 is charged to a predetermined potential.

On the peripheral surface of the charged photosensitive member 51, electrostatic latent images corresponding to intended image information are formed by a subsequent exposing unit 54. The electrostatic latent images are sequentially visualized as toner images by a subsequent developing member 55. The toner images are sequentially transferred onto a transfer material 57. The transfer material 57 is conveyed from a sheet feeding unit not shown in drawings to a transfer portion between the photosensitive member 51 and a transfer unit 56 at appropriate timing in such a manner as to be synchronized with the rotation of the photosensitive member 51. The transfer unit 56 is a transfer roller and performs opposite polarity charging to chat of the toner from the back side of the transfer material 57, transforming the toner images on the photosensitive member 51 to the transfer material 57. The transfer material 57 with the surface onto which the toner images have been transferred is separated from the photosensitive member 51 and conveyed to a fixing unit not shown in drawings. The toner is then fixed, and the transfer material 57 is put out as an image-formed product. From the peripheral surface of the photosensitive member 51 after image transfer, toner and the like remaining on the surface of the photosensitive member 51 are removed by a cleaning member 58 typified by an elastic blade. The peripheral surface of the photosensitive member 51 after the cleaning is subjected to the next cycle of the electrophotographic image forming process.

According to an aspect of the present invention, a charging member that can suppress charge injection into a photosensitive member and can stably charge a photosensitive member even when used in an electrophotographic image forming apparatus having high process speeds can be provided. According to another aspect of the present invention, an electrophotographic apparatus that gives high quality electrophotographic images can be provided.

EXAMPLES

The present invention will next be described in further detail with reference to examples, which are not intended to limit the present invention. In the following description, reagents and the like not specifically indicated were commercially available high purity products unless otherwise specified. In each example, a charging roller was produced.

Example 1

(Preparation of Unvulcanized Rubber Composition for Surface Layer)

The materials shown in Table 1 were mixed to give an A-kneaded rubber composition. The mixer used was a 6-liter pressure kneader (product name: TD6-15MDX, manufactured by Toshin Co., Ltd.). The mixing was performed in conditions of a filling rate of 70 vol % and a blade rotation speed of 30 rpm for 16 minutes.

TABLE 1

| Material name | Mixing amount (parts by mass) |
|---|---|
| NBR (trade name: JSR N230SL, manufactured by JSR Corporation) | 100 |
| Zinc stearate | 1 |
| Zinc oxide | 5 |
| Calcium carbonate (trade name: Super #1700, manufactured by Maruo Calcium) | 25 |
| Carbon black (trade name: TOKA BLACK #7270SB, manufactured by Tokai Carbon) | 50 |

Next, the above A-kneaded rubber was mixed with the materials shown in Table 2 to give an unvulcanized rubber composition-1. The mixer used was an open roll having a roll diameter of 12 inches (0.30 m). The mixing was performed in conditions of a front-roll rotation speed of 10 rpm, a back-roll rotation speed of 8 rpm, and a roll gap of 2 mm. Reciprocation was performed in the right and left direction 20 times in total, then the roll gap was adjusted at 0.5 mm, and the mixture was passed through the thin gap 10 times.

TABLE 2

| Material name | Mixing amount (parts by mass) |
|---|---|
| Sulfur | 1 |
| Vulcanization accelerator Tetramethylthiuram monosulfide (trade name: NOCCELER TS, manufactured by Ouchi Shinko Chemical Industrial) | 1 |
| Vulcanization accelerator Di-2-benzothiazolyl disulfide (trade name: NOCCELER DM, manufactured by Ouchi Shinko Chemical Industrial) | 1 |

The unvulcanized rubber composition-1 was further mixed with 20 parts by mass of spherical PMMA particles (trade name: GANZPEARL GM-0801, manufactured by Aica Kogyo Co., Ltd., hereinafter sometimes referred to as "particle No. 3") as insulating particles to give an unvulcanized rubber composition-1A containing the particle No. 3. The mixer used was an open roll having a roll diameter of 12 inches (0.30 m). The mixing was performed in conditions of a front-roll rotation speed of 8 rpm, a back-roll rotation speed of 10 rpm, and a roll gap of 2 mm. Reciprocation was performed in the right and left direction 20 times in total, then the roll gap was then adjusted at 0.5 mm, and the mixture was passed through the thin gap 10 times. PMMA means a polymethyl methacrylate resin.

(Measurement of Elongation at Break)

A tensile tester was used to measure the elongation at break of an unvulcanized rubber sheet. The unvulcanized rubber sheet used was prepared by molding the unvulcanized rubber composition-1A for a surface layer in a rectangular mold having a thickness of 2 mm. The molding was performed in conditions of a temperature of 80° C. and a pressure of 10 MPa. The measurement was performed by using a TENSILON universal tester RTG-1225 (trade name, manufactured by Orientec Co., Ltd.) in accordance with JIS K-6251. For the measurement, the unvulcanized rubber sheet was cut into a test piece having a No. 1 dumbbell shape, and the measurement was performed at a tension speed of 500 mm/min in an environment at 23° C./50% RH (relative humidity). The resulting elongation at break was 72%.

(Measurement of Volume Resistivity of Rubber Composition)

In order to measure the volume resistivity of a rubber composition not containing spherical PMMA particles that were contained in the unvulcanized rubber composition-1A, a rubber composition was prepared in the same manner as in the above (Preparation of unvulcanized rubber composition for surface layer) except that no spherical PMMA particles were added. The rubber composition was placed in a mold having a thickness of 2 mm and crosslinked at 10 MPa and 160° C. for 10 minutes, giving a rubber sheet having a thickness of 2 mm. The volume resistivity of the rubber sheet was measured by the 4-terminal 4-probe method. The measurement was performed with a resistivity meter (trade name: Loresta GP, manufactured by Mitsubishi Chemical Analytech Co., Ltd.) in an environment of 23° C./50% RH (relative humidity) in conditions of an applied voltage of 90 V and a load of 10 N. The resulting volume resistivity was 2,500 Ωcm.

(Measurement of Powder Resistivity of Insulating Particles)

The volume resistivity of particle No. 3, i.e. spherical PMMA particles (trade name: GANZPEARL GM-0801, manufactured by Aica Kogyo Co., Ltd.), was measured with a powder resistivity meter (trade name: Powder resistivity measurement system MCP-PD51, manufactured by Mitsubishi Chemical Analytech Co., Ltd.). The measurement was performed in an environment of 23° C./50% RH (relative humidity) at an applied voltage of 90 V and a load of 4 kN. The volume resistivity was $10^{10}$ Ωcm or more, which indicated insulating properties. In Table 3, particles having a volume resistivity of $10^{16}$ Ωcm or more are shown as insulating, and particles having a volume resistivity of $10^{3}$ Ωcm or less are shown, as electro-conductive, which are also applied to the following examples and comparative examples.

(Molding of Vulcanized Rubber Layer)

In order to prepare a mandrel having an adhesive layer for bonding a vulcanized rubber layer, the following operation was performed first. In other words, an electro-conductive vulcanized adhesive agent (trade name: METALOC U-20; manufactured by Toyokagaku Kenkyusho) was applied onto the center part having a length of 222 mm in the axis direction of an electro-conductive cylindrical mandrel having a diameter of 6 mm and a length of 252 mm (made from steel, with a nickel-plated surface), and was dried at 80° C. for 30 minutes.

The mandrel having the adhesive layer was covered with the unvulcanized rubber composition-1A for a surface layer by using a crosshead extrusion molding machine, giving an unvulcanized rubber roller in a crown shape. The molding was performed at a molding temperature of 100° C. and a screw rotation speed of 10 rpm while the feed speed of the mandrel was changed. The average take-up ratio in the axis direction of the unvulcanized rubber roller was set at 87%. The crosshead extrusion molding machine had a die inner diameter of 8.9 mm, and the unvulcanized rubber roller had an outer diameter of 8.6 mm at the center in the axis direction and had an outer diameter of 8.4 mm at each end part.

Subsequently, the unvulcanized rubber roller was heated in an electric furnace at a temperature of 160° C. for 40 minutes to vulcanize the unvulcanized rubber composition layer, giving a vulcanized rubber layer. Each end part of the vulcanized rubber layer was cut out to give a length of 232 mm in the axis direction.

(Electron Beam Irradiation of Vulcanized Rubber Layer after Extrusion)

The surface of the vulcanized rubber roller obtained after extrusion was irradiated with an electron beam, and a charging roller having a cured region on the surface of the elastic layer (surface layer) was obtained. For the irradiation with an electron beam, an electron beam irradiation device that gave a maximum acceleration voltage of 150 kV and a maximum electron current of 40 mA (manufactured by Iwasaki Electric Co., Ltd.) was used, and nitrogen was filled at the time of irradiation. The irradiation with an electron beam was performed in conditions of an acceleration voltage of 150 kV, an electron current of 35 mA, a dose of 1,323 kGy, a treatment speed of 1 m/min, and an oxygen concentration of 100 ppm.

(Measurement of Surface Roughness)

The ten-point average roughness Rz of the surface of the elastic layer was measured. The measurement apparatus used was a surface roughness measuring instrument (trade name: SURFCORDER SE3400, manufactured by Kosaka Laboratory Ltd.), and the probe used was a diamond contact probe having a tip radius of 2 μm. The measurement was performed in accordance with JIS B0601: 1982 at a measurement speed of 0.5 mm/s, a cut-off frequency λc of 0.8 mm, a standard length of 0.8 mm, and an evaluation length of 8.0 mm. For the Rz value of a charging roller, measurement was performed at three points in the axis direction×two points in the circumferential direction, at six points in total, per charging roller, and the average of six points was used. The resulting Rz was 15 μm.

(Observation of Insulating Particles)

Under a confocal microscope (trade name: OPTELICS HYBRID, manufactured by Lasertec Corporation), insulating particles on the surface of the charging roller were observed. The observation was performed in conditions of an objective lens magnification of 50, a pixel number of 1,024 pixels, and a height resolution of 0.1 μm. The insulating particles were present in an exposed state.

(Measurement of Gap Portion Distance)

The gap portion distance refers to the length of the longest line segment out of line segments formed by straight lines drawn from the outer edge of the insulating particle in a normal direction and points of intersection between the straight lines and the outer edge of the concave portion, in a projection view of a surface from a point of view in a normal direction with respect to the surface. The gap portion distance was measured by the following procedure. First, a height image of the charging roller surface was recorded by using a confocal microscope (trade name: OPTELICS HYBRID, manufactured by Lasertec Corporation). The observation was performed in conditions of an objective lens magnification of 50, a pixel number of 1,024 pixels, and a height resolution of 0.1 μm, and values obtained by plane correction of the recorded image into a quadric surface were used as the height values.

Next, an image processing software (trade name "Image-Pro Plus": manufactured by Planetron) was used to calculate a gap portion distance. First, the average height was used as a threshold, and the height image was binarized. Next, objects lower than the average height were automatically extracted by count/size. A normal line was drawn from the outer edge of an insulating particle in contact with the object, and the distance of a portion at the longest distance from the outer edge of the concave portion was measured. For objects at portions lower than the average value of the extracted heights, in the order of decreasing area, such operation was performed at 100 points in the vicinity of the center in the axis direction of the roller and 100 points in the vicinity of 20 mm from an end portion of the vulcanized rubber layer, and an average value was extracted. The average value was defined as the gap portion distance. When the distance is 10 μm or more to 70 μm or less, advantageous effects of the invention can be satisfactory exerted.

The resulting gap portion distance was 38 μm. The proportion of the gap portion distance in the end parts to the gap portion distance in the center part was 1.2. The gap portion distance in the center part is the average value of the distance of 100 objects in the vicinity of the center in the axis direction of the roller mentioned above, and the gap portion distance in the end parts is the average value of the distance of 100 objects in the vicinity of 20 mm apart from each end portion of the vulcanized rubber layer.

(Determination of Height of Convex Portion of Insulating Particle and Proportion of Depth to Long Diameter of Gap)

The convex height of an insulating particle and the proportion of the gap depth to the gap portion distance were determined by the following procedure. First, a height image of the charging roller surface was recorded by using a confocal microscope (trade name: OPTELICS HYBRID, manufactured by Lasertec Corporation). The observation was performed in conditions of an objective lens magnification of 50, a pixel number of 1,024 pixels, and a height resolution of 0.1 μm, and values obtained by plane correction of the recorded image into a quadric surface were used as the height values.

From the height image, a cross section profile of the periphery of a gap formed around the convex portion of an insulating particle was extracted, and the distance between the average height line and the top of the convex portion was determined. The distance was measured at 100 points (100 convex portions), and the average was calculated as the convex height. In a similar manner, the distance between the average height line and the bottom of a gap was determined, and was divided by the gap portion distance. This operation was performed at 100 points (100 concave portions), and the average was calculated as the proportion (percentage) of the gap depth to the gap portion distance. The convex height was 4 μm. The proportion of the gap depth to the gap portion distance was 23%.

(Determination of Orientation of Position of Center of Gravity of Gap Formed by Separation of Insulating Particle and Concave Portion and Position of Center of Gravity of Insulating Particle)

In order to determine the orientation of the position of the center of gravity of a gap formed by separation of an insulating particle and the concave portion and the position of the center of gravity of the insulating particle, an image was recorded under a transmission electron microscope (hereinafter abbreviated, as "TEM"). As the sample for TEM observation, a surface layer was sliced in such a manner as to cut concave portions along the average height plane of a surface shape to prepare a thin section. The thin section was prepared by an ultra-thin sectioning method. The ultramicrotome used was a cryomicrotome (trade name "Leica EM FCS", manufactured by Leica Microsystems). The cutting temperature was −100° C. The TEM used for observing the sample was H-7100FA (trade name) manufactured by Hitachi High-Technologies Corporation. The acceleration voltage was set at 100 kV, and the visual field was set to bright field. An image of the thin section, observed under the TEM was recorded in such a way as to give contrast differences between gaps (voids), insulating particles, and an electro-conductive rubber composition. If needed, image processing was performed to ternarized an image in terms of gaps (voids), insulating particles, and an electro-conductive rubber composition, and the resulting image was used.

In the image, x-coordinates and Y-coordinates of the center of gravity of an insulating particle in a concave portion and the gap were determined by a count/size function of an image processing software (trade name "Image-Pro Plus": manufactured by Planetron). An acute angle formed by a direction connecting the coordinates of the two points and the axis direction of the roller was measured at 100 points (100 concave portions), and the orientation angle of the positions of the center of gravity of gap formed by separation of insulating particle and the concave portion and the positions of the center of gravity of the insulating particle. The resulting orientation angle was 0°. Details of the charging roller of Example 1 and the tension strength at break of the unvulcanized rubber composition 1A containing particle No. 3 are shown in Table 3-1.

(Evaluation 1) Evaluation

The produced charging roller was installed on a black cartridge in an apparatus that was prepared by modifying an electrophotographic apparatus (trade name: LBP7200C manufactured by Canon, for recording on A4 paper in the longitudinal direction) so as to give a recording medium output speed of 200 mm/sec. The modified apparatus was used to output images in an environment at 15° C./10% RH (relative humidity).

As for the image output conditions, an image randomly printed in 1% by area of the image formable area on an A4 paper was used. An image was output, then the electrophotographic apparatus was stopped, and after 10 seconds, the image formation was restarted. This operation was repeated to perform a durability test of 30,000 image output. Output conditions for an image for evaluation after 30,000-sheet endurance were as follows: a halftone image (intermediate-density image in which horizontal lines each having a width of 1 dot were drawn at an interval of 2 dots in a direction perpendicular to the rotation direction of the photosensitive member) was output on one sheet. The image was used to evaluate charging uniformity in terms of the presence or absence of horizontal streak-like image unevenness on the basis of the following criteria. The evaluation was performed by observing an image in the vicinity of the center part of the charging roller in the axis direction and in the vicinity of 20 mm apart from each end of the vulcanized rubber layer.

A: No horizontal streak-like image unevenness was observed.

B: No horizontal streak-like image unevenness was observed, but the image had a slight granular texture.

C: Slight horizontal streak-like image unevenness was observed in such a degree as not to cause problems in practice.

D: Horizontal streak-like image unevenness was observed, and the image quality was impaired.

E: Horizontal streak-like image unevenness was observed, and the image quality was markedly impaired.

In Example 1, the surface shape including the convex height, the gap portion distance, the orientation of the position of the center of gravity of a gap formed by separation of an insulating particle and the concave portion and the position of the center of gravity of the insulating particle, the proportion of the gap portion distance in the center part and the end parts, and Rz was appropriate. Accordingly, the charging uniformity in terms of the presence or absence of horizontal streak-like image unevenness was evaluated as rank A, and high image-quality was maintained.

(Evaluation 2) Potential Evaluation before and after Durability Test

In the above electrophotographic apparatus, the charging roller rotates following the photosensitive member. The photosensitive member and the charging roller in the electrophotographic apparatus were integrated with a jig that can drive the photosensitive member and the charging roller independently, and a potential change before and after the durability test was observed. In order to evaluate charge transfer by contact, the evaluation was performed in an environment of 30° C./90% RH, at a charging roller potential of 500 V, a photosensitive member rotation speed of 200 mm/sec, and a charging roller rotation speed of 220 mm/sec. Before and after the durability test, the photosensitive member was rotated once in the conditions, and then the potential of the charging roller was measured. The difference was calculated as the potential difference before and after the durability test. The resulting potential difference of the charging roller of Example 1 before and after the durability test was 28 V.

(Evaluation 3) Evaluation 3 by Insufficient Charging

With the electrophotographic apparatus used in Evaluation 1, a halftone image for evaluation (an image at an intermediate concentration in which horizontal lines having a width of 1 dot were drawn at intervals of 2 dots in a direction perpendicular to the rotation direction of the photosensitive member) was output as the first image. The image was used to evaluate fogging on the basis of the following criteria.

A: No image unevenness with dots was observed.

B: Extremely slight image unevenness with dots was observed.

C: Slight image unevenness with dots was observed in such a degree as not to cause problems in practice.

D: Image unevenness with dots were observed in a wide area on an image, and the image quality was markedly impaired.

The evaluation evaluates image unevenness with dots (called fogging) caused by insufficient discharging from gaps.

In Example 1, the surface shape including the gap portion distance, the proportion of the gap depth to the gap portion distance, and Rz was appropriate. Accordingly, the image unevenness with dots was evaluated as rank A, and high image quality was maintained. The results of evaluations 1 to 3 are shown in Table 5-1.

TABLE 3-1

| | Example | | | | | | | Comparative Example | |
|---|---|---|---|---|---|---|---|---|---|
| | 1 | 2 | 3 | 4 | 5 | 6 | 7 | 1 | 2 |
| Material (trade name, maker) parts by mass | | | | | | | | | |
| NBR (N230SL, JSR) | 100 | 100 | 100 | 100 | 100 | 100 | 100 | 100 | 100 |
| Carbon black (TOKA BLACK #7270SB, TOKIA CARBON) | 50 | 50 | 50 | 50 | 50 | 50 | 50 | 50 | 50 |
| Zinc oxide | 5 | 5 | 5 | 5 | 5 | 5 | 5 | 5 | 5 |
| Zinc stearate | 1 | 1 | 1 | 1 | 1 | 1 | 1 | 1 | 1 |
| Calcium carbonate (Super #1700, Maruo Calcium) | 25 | 50 | 50 | 25 | 0 | 25 | 25 | 75 | 25 |
| Sodium hydrogen carbonate (Cellmic 266, Sankyo Kasei) | | | | | | | | | |
| Sulfur | 1 | 1 | 1 | 1 | 1 | 1 | 1 | 1 | 1 |
| Vulcanization accelerator Tetramethylthiuram monosulfide (trade name: NOCCELER TS, manufactured by Ouchi Shinko Chemical Industrial) | 1 | 1 | 1 | 1 | 1 | 1 | 1 | 1 | 1 |
| Vulcanization accelerator Di-2-benzothiazolyl disulfide (trade name: NOCCELER DM, manufactured by Ouchi Shinko Chemical Industrial) | 1 | 1 | 1 | 1 | 1 | 1 | 1 | 1 | 1 |
| Particle No. 1 | | | | | | 20 | | | |
| Particle No. 2 | | | | | | | 20 | | |
| Particle No. 3 | 20 | 20 | 20 | 20 | 20 | | | 20 | |
| Processing conditions | | | | | | | | | |
| Elongation at break (%) | 72 | 64 | 64 | 72 | 79 | 77 | 75 | 55 | 72 |
| Take-up ratio (%) | 87 | 94 | 90 | 82 | 77 | 87 | 87 | 104 | 87 |

TABLE 3-2

| | Example | | | | | | Comparative Example | |
|---|---|---|---|---|---|---|---|---|
| | 8 | 9 | 10 | 11 | 12 | 13 | 3 | 4 |
| Material (trade name, maker) parts by mass | | | | | | | | |
| NBR (N230SL, JSR) | 100 | 100 | 100 | 100 | | 100 | 100 | 100 |
| Hydrin rubber (EPION 301, Osaka Soda) | | | | | 100 | | | |
| Carbon black (TOKA BLACK #7270SB, TOKIA CARBON) | 50 | 50 | 50 | 50 | 50 | 50 | 50 | 50 |
| Zinc oxide | 5 | 5 | 5 | 5 | 5 | 5 | 5 | 5 |
| Zinc stearate | 1 | 1 | 1 | 1 | 1 | 1 | 1 | 1 |
| Calcium carbonate (Super #1700, Maruo Calcium) | 25 | 25 | 25 | 25 | 25 | 25 | 25 | 25 |
| Sodium hydrogen carbonate (Cellmic 266, Sankyo Kasei) | | | | | | 5 | | |
| Sulfur | 1 | 1 | 1 | 1 | 1 | 1 | 1 | 1 |
| Vulcanization accelerator Tetramethylthiuram monosulfide (trade name: NOCCELER TS, manufactured by Ouchi Shinko Chemical Industrial) | 1 | 1 | 1 | 1 | 1 | 1 | 1 | 1 |
| Vulcanization accelerator Di-2-benzothiazolyl disulfide (trade name: NOCCELER DM, manufactured by Ouchi Shinko Chemical Industrial) | 1 | 1 | 1 | 1 | 1 | 1 | 1 | 1 |
| Particle No. 3 | | | | | 20 | | | 20 |
| Particle No. 4 | 20 | | | | | | | |
| Particle No. 5 | | 20 | | | | | | |
| Particle No. 6 | | | 20 | | | * | | |
| Particle No. 7 | | | | 20 | | | | |
| Particle No. 8 | | | | | | | 20 | |
| Processing conditions | | | | | | | | |
| Elongation at break (%) | 67 | 65 | 70 | 71 | 113 | 75 | 73 | 72 |
| Take-up ratio (%) | 94 | 94 | 96 | 87 | 90 | 104 | 87 | 87 |

*) used in a trace amount for fusion to the surface to form convex portions.

Examples 2 to 12, Comparative Examples 1 to 3

Unvulcanized rubber compositions containing particles were prepared in accordance with the formulae as shown in Table 3-1 and Table 3-2 in the same manner as the unvulcanized rubber composition-1A containing particle No. 3 in Example 1. The take-up ratio at the time of extrusion molding was changed. Charging rollers of Examples 2 to 12 and Comparative Examples 1 to 3 were produced and evaluated in the same manner as in Example 1 except the above conditions. In Example 12, hydrin rubber was used in place of NBR. In Comparative Example 2, no insulating particles were added. Details and processing conditions of the charging rollers of Examples 2 to 12 and Comparative Examples 1 to 3 are shown in Table 3-1 and Table 3-2. The evaluation results are shown in Table 5-1 and Table 5-2. The materials and average particle sizes of particles used in Examples and Comparative Examples are shown in Table 6 together.

Comparative Example 4

On the surface of a vulcanized rubber roller molded in the same manner as in Example 1, a coating layer was formed to prepare a charging roller, and the same measurements and evaluations as in Example 1 were performed. The charging roller was prepared by the following procedure.

The materials shown in Table 4 were mixed to prepare a mixed liquid.

TABLE 4

| Material name | Mixing amount (parts by mass) |
|---|---|
| Polyol | 100 |
| IPDI | 22.5 |
| HDI | 33.6 |
| Carbon black | 30 (corresponding to 10% by volume |
| Methyl isobutyl ketone (MIBK) | 500 |

The polyol is a polyol (trade name "PLACCEL DC2016": manufactured by Daicel Chemical Industries, Ltd.) (a solid content of 7.0% by mass) serving as a binder for a coating layer. IPDI (isophorone diisocyanate) is a block isocyanate IPDI (trade name "Vestanat B1370": manufactured by Degussa-Huls) that is added as an isocyanate monomer serving as a binder for a coating layer. HDI (hexamethylene diisocyanate) is a block isocyanate HDI (trade name "Duranate TPA-B80E": manufactured by Asahi Kasei Corporation) that is added as an isocyanate monomer serving as a binder for a coating layer. Carbon black is electro-conductive particles.

In a glass bottle, the mixed liquid was placed together with glass beads having an average particle size of 0.8 mm, and was dispersed for 60 hours by using a paint shaker disperser to give a paint 1 for a coating layer. A vulcanized rubber roller molded in the same manner as in Example 1 was coated with the paint 1 for a coating layer by dipping. Subsequently, the coated roller was air-dried at normal temperature for 30 minutes or more and then was heated at 160° C. for 1 hour to give a charging roller of Comparative Example 4. The coating layer had a film thickness of 2 μm.

Details and evaluation results of the charging roller of Comparative Example 4 are shown in Table 3.

Example 13

The unvulcanized rubber composition-1 (the amount of NBR was 100 parts by mass) in Example 1 was mixed with 5 parts by mass of sodium hydrogen carbonate (trade name: Cellmic 266, manufactured by Sankyo Kasei) as a foaming agent, giving an unvulcanized rubber composition-2 containing a foaming agent. The mixer used was an open roll having a roll diameter of 12 inches (0.30 m). The mixing was performed in conditions of a front-roll rotation speed of 8 rpm, a back-roll rotation speed of 10 rpm, and a roll gap of 2 mm. Reciprocation was performed in the right and left direction 20 times in total, then the roll gap was then adjusted at 0.5 mm, and the mixture was passed through the thin gap 10 times.

(Molding of Vulcanized Rubber Layer)

In order to prepare a mandrel having an adhesive layer for bonding a vulcanized rubber layer, the following operation was performed first. In other words, an electro-conductive vulcanized adhesive agent (trade name: METALOC U-20; manufactured by Toyokagaku Kenkyusho) was applied onto the center, part having a length of 222 mm in the axis direction of an electro-conductive cylindrical mandrel having a diameter of 6 mm and a length of 252 mm (made from steel, with a nickel-plated surface), and was dried at 80° C. for 30 minutes.

The mandrel having the adhesive layer was covered with the unvulcanized rubber composition-2 for a surface layer by using a crosshead extrusion molding machine, giving an unvulcanized rubber roller in a non-crown shape. The molding was performed at a molding temperature of 100° C. and a screw rotation speed of 10 rpm while the feed speed of the mandrel was constant. The average take-up ratio in the axis direction of the unvulcanized rubber roller was 103%. The crosshead extrusion molding machine had a die inner diameter of 9.0 mm, and the unvulcanized rubber roller had an outer diameter of 9.1 mm at the center in the axis direction and had an outer diameter of 9.1 mm at each end part.

In the same manner as in (Molding of vulcanized rubber layer) in Example 1, the unvulcanized rubber roller was subsequently heated in an electric furnace at a temperature of 160° C. for 40 minutes to vulcanize the unvulcanized rubber composition layer, giving a vulcanized rubber layer. Each end part of the vulcanized rubber layer was cut out to give a length of 232 mm in the axis direction. Next, the surface of the vulcanized rubber layer was ground with a grinder of a plunge cut grinding system into a crown shape having an end diameter of 8.4 mm and a center diameter of 8.6 mm. Consequently, a vulcanized rubber roller having a vulcanized rubber layer with the surface on which concave portions derived from voids formed by foaming of a foaming agent were formed was obtained.

Spherical polyethylene particles (trade name: Mipelon PM200, manufactured by Mitsui Chemicals, Inc) were mixed with water so that the amount of the insulating particles was 0.1% by mass relative to water, and the mixture was dispersed with an ultrasonic cleaner. In the insulating particle dispersion liquid, the vulcanized rubber roller was immersed and then was pulled up at a speed of 50 mm/sec. The unvulcanized rubber roller was air-dried to evaporate water, and the vulcanized rubber layer was coated with the spherical resin particles. The spherical polyethylene particles was melted by heating in an electric furnace at a temperature of 180° C. for 15 minutes, and the spherical polyethylene particles were fused with the surface of the vulcanized rubber roller. While the mandrel of the vulcanized rubber roller was gripped at both ends and was rotated at 60 rpm, a wrapping film (trade name: 3M Wrapping film sheet #4000, manufactured by 3M) was next pressed against the roller to polish the surface, and spherical polyethylene particles bonded to other areas than the concave portions were removed. Consequently, a charging roller of Example 13 was obtained. Details of the charging roller of Example 13 are shown in Table 3. The evaluation results are shown in Table 5-2.

All the insulating particles, used in Examples 1 to 13 and Comparative Examples 1 to 4 had a sphericity (shape factor SF1) of 100 or more to 160 or less.

As shown in Table 5-1 and Table 5-2, the charging uniformity was evaluated as ranks A to C, the potential difference before and after the durability test was suppressed to 50 V or less, and the fogging was evaluated as ranks A to C, in the charging members of Examples 1 to 13 pertaining to the present invention.

In Examples 1 to 13, it is observed that a charging member having higher convex portions, an appropriate gap portion distance, and an orientation angle of insulating particles and gaps closer to 0° is more likely to suppress horizontal stripes. It is also observed that a charging member having a larger proportion of the gap portion distance in the end parts to the gap portion distance in the center part and having a larger Rz is more likely to suppress horizontal stripes. It is also observed that a charging member having higher convex portions, a larger Rz, and a lower conductivity of convex portions is more likely to give a small potential difference before and after the durability test. The charging member of Example 12 included ion conductive hydrin rubber, thus charge transfer by contact was likely to be caused as compared with NBR, and the potential difference was 49 V. In the fogging evaluation, it is observed that a charging member having a shorter gap portion distance, a smaller proportion of the gap depth to the gap portion distance, and a smaller Rz is more unlikely to cause fogging.

In contrast, the charging member of Comparative Example 1 had no gaps, and thus the charging uniformity was evaluated as rank C in the center part and as rank D in the end parts. The charging member of Comparative Example 2 included no insulating particles, thus the Rz was small, the charging uniformity was evaluated as rank E in each of the center part and the end parts, and the potential difference before and after the durability test was 87 V. In the charging member of Comparative Example 3, the electro-conductive particles were used, thus charge transfer by contact with a photosensitive member was likely to cause, and the potential difference before and after the durability test was 112 V. In Comparative Example 4, the surface of the insulating particles was covered with an electro-conductive coating layer, thus the charging uniformity was evaluated as rank B in each of the center part and the end parts, and the potential difference before and after the durability test was 78 V. The reason the charging uniformity was evaluated as rank D is supposed to be that both the convex portions and the concave portions were electro-conductive, and thus charge-up by the discharge between the convex portions and the concave portions did not occur. In addition, the convex portions had conductivity, and thus the potential difference before and after the durability test became high.

The results of the fogging evaluation in evaluation 3 indicate that contamination around the convex portions by toner and the like is also suppressed in Examples 1 to 13.

TABLE 5-1

| | Example | | | | | | | Comparative Example | |
|---|---|---|---|---|---|---|---|---|---|
| | 1 | 2 | 3 | 4 | 5 | 6 | 7 | 1 | 2 |
| Surface state | | | | | | | | | |
| Conductivity of particles | Insulating | Insulating | Insulating | Insulating | Insulating | Insulating | Insulating | Insulating | — |
| Volume resistivity of rubber composition (Ω · cm) | 2500 | 2900 | 2900 | 2500 | 1800 | 2500 | 2500 | 3400 | 2500 |
| Insulating particle state | Exposed | Exposed | Exposed | Exposed | Exposed | Exposed | Exposed | Exposed | — |
| Height of convex portion (μm) | 4 | 2 | 4 | 3 | 2 | 2 | 3 | 3 | — |
| Gap portion distance (μm) | 38 | 5 | 10 | 70 | 102 | 14 | 17 | 0 | — |
| Proportion of gap depth to gap portion distance (%) | 23 | 48 | 32 | 27 | 31 | 24 | 18 | — | — |
| Proportion of gap portion distance in end parts to gap portion distance in center part | 1.2 | 1.1 | 1.2 | 1.3 | 1.4 | 1.2 | 1.2 | — | — |
| Orientation angle of insulating particle centroid and gap centroid (°) | 3 | 19 | 9 | 2 | 4 | 8 | 16 | — | — |
| Rz (μm) | 15 | 8 | 12 | 24 | 31 | 11 | 13 | 9 | 3 |
| Roller evaluation | | | | | | | | | |
| Charging uniformity (center part/end part) | A/A | B/B | A/A | A/A | B/B | B/B | A/A | C/D | E/E |
| Potential difference before and after durability test | 28 | 41 | 33 | 24 | 31 | 42 | 32 | 54 | 87 |
| Fogging | A | A | A | B | C | A | A | A | A |

TABLE 5-2

| | Example | | | | | | Comparative Example | |
|---|---|---|---|---|---|---|---|---|
| | 8 | 9 | 10 | 11 | 12 | 13 | 3 | 4 |
| Surface state | | | | | | | | |
| Conductivity of particles | Insulating | Insulating | Insulating | Insulating | Insulating | Insulating | Electro-conductive | Insulating |
| Volume resistivity of rubber composition (Ω · cm) | 2500 | 2500 | 2500 | 2500 | 1000 | 4200 | 2500 | 2500 |
| Insulating particle state | Exposed | Exposed | Exposed | Exposed | Exposed | Exposed | Exposed | Covered |
| Height of convex portion (μm) | 12 | 15 | 5 | 4 | 3 | 3 | 3 | 2 |
| Gap portion distance (μm) | 52 | 66 | 51 | 47 | 75 | 12 | 35 | 28 |
| Proportion of gap depth to gap portion distance (%) | 23 | 22 | 51 | 13 | 39 | 52 | 47 | 9 |
| Proportion of gap portion distance in end parts to gap portion distance in center part | 1.1 | 1.1 | 1.1 | 1.2 | 1.2 | 1.0 | 1.2 | 1.2 |
| Orientation angle of insulating particle centroid and gap centroid ° | 1 | 3 | 2 | 2 | 2 | 47 | 1 | 4 |
| Rz (μm) | 21 | 27 | 23 | 16 | 19 | 14 | 17 | 7 |
| Roller evaluation | | | | | | | | |
| Charging uniformity (center part/end part) | A/A | A/A | A/B | A/A | A/A | B/C | A/A | D/D |
| Potential difference before and after durability test | 25 | 19 | 31 | 27 | 49 | 34 | 112 | 78 |
| Fogging | A | B | B | A | C | A | B | A |

TABLE 6

| Particle No. | Material (trade name, etc.) | Average particle size (μm) |
|---|---|---|
| Particle No. 1 | Spherical PMMA particles (trade name: GANZPEARL GM0401, Aica Kogyo) | 4 |

TABLE 6-continued

| Particle No. | Material (trade name, etc.) | Average particle size (μm) |
|---|---|---|
| Particle No. 2 | Spherical polystyrene particles (trade name: Techpolymer SBX-6, Sumitomo Kasei) | 6 |

TABLE 6-continued

| Particle No. | Material (trade name, etc.) | Average particle size (μm) |
|---|---|---|
| Particle No. 3 | Spherical PMMA particles (trade name: GANZPEARL GM0801, Aica Kogyo) | 8 |
| Particle No. 4 | Spherical PMMA particles (GANZPEARL GM3001, Aica Kogyo) | 30 |
| Paritcle No. 5 | Spherical PMMA particles (trade name: Techpolymer MBX-40, SEKISUI PLASTICS CO., Ltd.) | 40 |
| Particle No. 6 | Spherical polyethylene particles (trade name: Mipelon PM200, Mitsui Chemicals) | 9 |
| Particle No. 7 | Spherical silica particles (trade name: FB-12D, Denki Kagaku Kogyo) | 10 |
| Particle No. 8 | Spherical carbon particles (trade name: Glassy Carbon, TOKAI CARBON) | 8 |

While the present invention, has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-210022, filed Oct. 26, 2015, and Japanese Patent Application. No. 2016-156600, filed Aug. 9, 2016, which are hereby incorporated by reference herein in their entirety.

What is claimed is:

1. A charging member comprising:

an electro-conductive support; and an electro-conductive surface layer, the electro-conductive surface layer including, on an outer surface thereof, concave portions that are independent of each other, a part of a wall of each of the concave portions constituting a part of the charging member outer surface, each of the concave portions holding an insulating particle positioned therein, wherein the insulating particle being exposed to a surface of the charging member and forming a convex portion on the surface of the charging member, an orthogonal projection image is obtained when each of the concave portions and the insulating particle held in each of the concave portions are orthogonally projected on a surface of the electro-conductive support, in the orthogonal projection image, a site exists in which an outer edge of a projection image derived from the insulating particle and an outer edge of a projection image derived from each of the concave portions are separated, an average value of acute angles is from 0° to less than 45°, each of the acute angles being formed by (I) a line segment and (II) a longitudinal direction of the charging member, the line segment connecting (i) a center of gravity of a gap formed by separation of the insulating particle and each of the concave portion, and (ii) a center of gravity of the insulating particle and the insulating particle has an average particle size of 6 to 30 μm, and a distance of the site in which the outer edge of the projection image derived from the insulating particle and the outer edge of the projection image derived from the each of the concave portions are separated is 10 to 70 μm.

2. An electrophotographic apparatus comprising:

a charging member including an electro-conductive support and an electro-conductive surface layer; and a member to be charged placed in contact with the charging member and chargeable by the charging member, an outer surface of the charging member providing concave portions that are independent of each other, a part of a wall of each of the concave portions constituting a part of the charging member outer surface, each of the concave portions holding an insulating particle positioned therein, wherein the insulating particle being exposed to a surface of the charging member and forming a convex portion on the surface of the charging member, an orthogonal projection image is obtained when each of the concave portions and the insulating particle held in each of the concave portions are orthogonally projected on a surface of the electro-conductive support, in the orthogonal projection image, a site exists in which an outer edge of a projection image derived from the insulating particle and an outer edge of a projection image derived from each of the concave portions are separated, an average value of acute angles is from 0° to less than 45°, each of the acute angles being formed by (l) a line segment and (II) a longitudinal direction of the charging member, the line segment connecting (i) a center of gravity of a gap formed by separation of the insulating particle and each of the concave portion, and (ii) a center of gravity of the insulating particle and the insulating particle has an average particle size of 6 to 30 μm, and a distance of the site in which the outer edge of the projection image derived from the insulating particle and the outer edge of the projection image derived from the each of the concave portions are separated is 10 to 70 μm.

3. The electrophotographic apparatus according to claim 2, wherein the charging member is capable of being driven at a charging member peripheral speed at least 1.05 times, or less than 0.95 times of a peripheral speed of the member to be charged.

4. The charging member according to claim 1, wherein the average value of acute angles is 0° to 20°.

5. The electrophotographic apparatus according to claim 3, wherein the average value of acute angles is 0° to 20°.

* * * * *